US011382359B2

(12) United States Patent
Janardhan et al.

(10) Patent No.: US 11,382,359 B2
(45) **Date of Patent: *Jul. 12, 2022**

(54) E-VAPING SECTION WITH FLOW RESTRICTOR TO PROVIDE DESIRED RESISTANCE-TO-DRAW (RTD)

(71) Applicant: Altria Client Services LLC, Richmond, VA (US)

(72) Inventors: Srinivasan Janardhan, Glen Allen, VA (US); Eric Hawes, Midlothian, VA (US); Yezdi B. Pithawalla, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 88 days.

This patent is subject to a terminal disclaimer.

(21) Appl. No.: 16/937,860

(22) Filed: Jul. 24, 2020

(65) Prior Publication Data

US 2020/0352233 A1 Nov. 12, 2020

Related U.S. Application Data

(62) Division of application No. 15/993,992, filed on May 31, 2018, now Pat. No. 10,729,183, which is a (Continued)

(51) Int. Cl.
*A24F 47/00* (2020.01)
*A24F 40/485* (2020.01)
(Continued)

(52) U.S. Cl.
CPC ..... *A24F 40/485* (2020.01); *A24F 40/40* (2020.01); *A24F 40/10* (2020.01)

(58) Field of Classification Search
CPC ..... A24F 40/40; A24F 40/485
See application file for complete search history.

(56) References Cited

U.S. PATENT DOCUMENTS 5,743,251 A 4/1998 Howell et al.
6,164,287 A 12/2000 White
(Continued)

FOREIGN PATENT DOCUMENTS

CN 201085044 Y 7/2008
CN 101522063 A 9/2009
(Continued)

OTHER PUBLICATIONS

International Search Report and Written Opinion dated May 13, 2015.
(Continued)

*Primary Examiner* — Eric Yaary
(74) *Attorney, Agent, or Firm* — Harness, Dickey & Pierce, P.L.C.

(57) ABSTRACT

The e-vaping section includes a housing, the housing defining an inlet to allow air to be drawn into and through an airflow path, a reservoir in the housing, the reservoir being configured to contain a pre-vapor formulation, a heater and wick arrangement in fluid communication with the reservoir and the airflow path, the heater and wick arrangement being configured to volatilize the pre-vapor formulation to produce a vapor, a connector on a first end of the e-vaping section, an electrical terminal held within connector, an annular seal in fluid communication with the inlet, the annular seal defining a first air passage of the airflow path, and a flow restrictor being held by the annular seal, the flow restrictor defining a second air passage of the airflow path, the flow restrictor being configured to provide a desired resistance-to-draw (RTD) for the e-vaping section, the annular seal encompassing the flow restrictor.

20 Claims, 6 Drawing Sheets

Related U.S. Application Data division of application No. 14/337,872, filed on Jul. 22, 2014, now Pat. No. 10,010,109.

(60) Provisional application No. 61/857,931, filed on Jul. 24, 2013.

(51) Int. Cl.
*A24F 40/40* (2020.01)
*A24F 40/10* (2020.01)

(56) References Cited

U.S. PATENT DOCUMENTS

| | | | |
|---|---|---|---|
| 7,131,599 | B2 | 11/2006 | Katase |
| 2004/0134631 | A1 | 7/2004 | Crooks et al. |
| 2008/0092912 | A1 | 4/2008 | Robinson et al. |
| 2011/0011396 | A1 | 1/2011 | Fang |
| 2011/0036346 | A1 | 2/2011 | Cohen et al. |
| 2011/0120482 | A1 | 5/2011 | Brenneise |
| 2011/0155153 | A1 | 6/2011 | Thorens et al. |
| 2011/0303231 | A1 | 12/2011 | Li et al. |
| 2012/0279512 | A1 | 11/2012 | Hon |
| 2012/0285475 | A1 | 11/2012 | Liu |
| 2012/0318882 | A1 | 12/2012 | Abehasera |
| 2013/0228191 | A1 | 9/2013 | Newton |
| 2014/0000638 | A1 | 1/2014 | Sebastian et al. |
| 2014/0130817 | A1 | 5/2014 | Li et al. |
| 2014/0190478 | A1 | 7/2014 | Liu |
| 2014/0216450 | A1 | 8/2014 | Liu |
| 2014/0246032 | A1 | 9/2014 | Scatterday |
| 2014/0290675 | A1 | 10/2014 | Xiang |
| 2014/0311506 | A1 | 10/2014 | Liu |
| 2014/0332019 | A1 | 11/2014 | Liu |
| 2015/0020826 | A1 | 1/2015 | Liu |
| 2015/0128970 | A1 | 5/2015 | Liu |
| 2016/0106154 | A1 | 4/2016 | Lord |

FOREIGN PATENT DOCUMENTS

| | | | |
|---|---|---|---|
| CN | 201379072 | Y | 1/2010 |
| CN | 101878958 | A | 11/2010 |
| CN | 102753047 | A | 10/2012 |
| EP | 2022349 | A1 | 2/2009 |
| EP | 2110033 | A1 | 10/2009 |
| WO | WO-94/06314 | A1 | 3/1994 |
| WO | WO-2011/124033 | A1 | 10/2011 |
| WO | WO-2014177860 | A1 | 11/2014 |

OTHER PUBLICATIONS

Examination Report dated Sep. 13, 2017 in European Application No. 14750850.1.

Eurasian Official Notification dated Dec. 20, 2017 in Eurasian Patent Application No. 201690270, with English translation.

Chinese Office Action and Search Report dated Jan. 23, 2018 in related Chinese Application No. 201480052475.3, with English translation.

Third Party Observation for related Application No. EP20140750850, issued Feb. 9, 2018.

Intention to Grant dated May 14, 2018 in related European Application No. 14750850.1.

Chinese Office Action dated Aug. 14, 2018 in related Chinese Application No. 201480052475.3, with an English translation.

European Office Action dated Oct. 24, 2018 for EP 14 750 850.1.

Office Action for corresponding Israeli Application No. 243751 dated Feb. 24, 2019 and English translation.

E-VAPING SECTION WITH FLOW RESTRICTOR TO PROVIDE DESIRED RESISTANCE-TO-DRAW (RTD)

RELATED APPLICATIONS

This application is a divisional of U.S. application Ser. No. 15/993,992, filed May 31, 2018, which is a divisional of U.S. application Ser. No. 14/337,872, filed Jul. 22, 2014, which claims priority under 35 U.S.C. 119 to U.S. Provisional Patent Application No. 61/857,931, filed on Jul. 24, 2013, the entire contents of each of which are hereby incorporated by reference in their entirety.

FIELD

Electronic smoking articles.

SUMMARY

In accordance with an exemplary embodiment, an electronic smoking article capable of providing a cigarette experience without combusting tobacco, comprises: an outer cylindrical housing extending in a longitudinal direction, the outer cylindrical housing having one or more inlets configured to allow air to be drawn into the smoking article; a power source; a cartomizer, which includes: a reservoir; a heater and wick arrangement in communication with the reservoir including liquid material and operative to volatilize liquid material to produce an aerosol; and a gasket in fluid communication with the one or more inlets and configured to provide a seal with an interior surface of the outer cylindrical housing and having a central, longitudinal air passage configured to provide resistance-to-draw (RTD) to the smoking article, and wherein a combined air flow area of the one or more inlets of the outer cylindrical housing is greater than a cross-sectional area of the longitudinal air passage of the gasket; a condensation chamber in communication with an outlet on a downstream end of the cartomizer; and a mouth-end insert.

In accordance with an exemplary embodiment, an electronic smoking article capable of providing a cigarette experience without combusting tobacco, comprises: a reusable portion housing a power source and circuitry; a cartomizer portion housing a cartomizer, which includes: a reservoir; and a heater and wick arrangement in communication with the reservoir including liquid material and operative to volatilize liquid material to produce an aerosol; a condensation chamber in communication with an outlet on a downstream end of the air flow channel; and a mouth-end insert; and a connector configured to connect the reusable portion to the cartomizer portion, and wherein the connector has a plurality of circumferentially spaced apart slots, which is in fluid communication with one or more cartomizer holes, and wherein the one or more cartomizer holes are configured to provide a source of air flow to the heater and wick arrangement of the cartomizer, and wherein a combined air flow area of the plurality of circumferentially spaced apart slots is greater than a combined cross-sectional area of the one or more cartomizer holes.

In accordance with an exemplary embodiment, an electronic smoking article capable of providing a cigarette experience without combusting tobacco, comprises: a reusable portion housing a power source and circuitry; a cartomizer portion housing a cartomizer, which includes: a reservoir; and a heater and wick arrangement in communication with the reservoir including liquid material and operative to volatilize liquid material to produce an aerosol; a condensation chamber in communication with an outlet on a downstream end of the air flow channel; and a mouth-end insert; and at least one vent hole positioned in the reusable portion of the smoking article between a downstream end of the power source and the cartomizer portion, and wherein the at least one vent hole is in fluid communication with a flow control insert located on an upstream end of an air flow channel of the cartomizer, the flow control insert having at least one cartomizer inlet configured to control an amount of air flow to the cartomizer, and wherein an air flow area of the at least one vent hole is greater than an air flow area of the at least one cartomizer inlet.

In accordance with an exemplary embodiment, a method of controlling resistance-to-draw of an electronic smoking article, which includes a reusable portion and a cartomizer portion, comprises: supplying an air flow from one or more inlets in an outer cylindrical housing of the smoking article to a cartomizer via a cartomizer inlet having a fixed diameter configured to control a resistance-to-draw of the smoking article and wherein the cartomizer inlet is located inside the outer cylindrical housing of the electronic smoking article, and wherein a combined air flow area of the one or more inlets in the outer housing of the smoking article is greater than a cross-sectional area of the cartomizer inlet; heating a liquid material from a reservoir to form an aerosol in a central air channel; combining the at least initially volatilized liquid material with the air flow from the cartomizer inlet; and condensing the saturated vapor within the condensation chamber in communication with the air flow channel to form the aerosol.

In accordance with an exemplary embodiment, a method of establishing a common, predetermined RTD consistently amongst a plurality of electronic smoking articles includes: for each electronic smoking article, establishing an airflow path within said electronic smoking article and including at a location along said airflow path a passage through a resilient gasket; and for each smoking article, determining an RTD by disposing a common, rigid tubular member at a location along said passageway, said tubular member having an inner diameter that establishes said common, predetermined RTD in said smoking article.

The electronic smoking article can also include a mouth-end insert in fluid communication with the condensation chamber so as to deliver aerosol to a smoker (or vaporer).

As used herein, the term "electronic smoking article" is inclusive of all types of electronic smoking articles, regardless of form, size or shape, including electronic cigarettes, electronic cigars, electronic pipes, electronic hookahs and the like. The liquid aerosol formulation can include nicotine or be nicotine free. Moreover, the liquid aerosol formulation can include tobacco flavors or instead, or in combination include other suitable flavors

BRIEF DESCRIPTION OF THE DRAWINGS

The accompanying figures are included to provide a further understanding of the invention, and are incorporated in and constitute a part of this specification. The figures illustrate embodiments of the invention and, together with the description, serve to explain the principles of the invention.

DETAILED DESCRIPTION

In an electronic smoking article 100, the difference between the pressure of the incoming and outgoing air can be referred to as the resistance-to-draw (RTD) of the article 100. For example, the resistance-to-draw is the resistance offered by the electronic smoking article 100, as the smoker (or vaporer) draws on the article. Having an article's resistance-to-draw (RTD) within an appropriate range can be important for delivering a good smoker experience. For example, the factors that define the RTD of an electronic smoking article 100 can include the resistance offered to the airflow by the geometry of the article 100 and the flow rate at which air is drawn into the article 100. While the flow rate can be controlled by the smoker, the geometry design of the article 100 can be used to achieve a targeted RTD range and regulate which hole(s) or passage(s) within the article 100 can control the RTD of the article 100.

In some electronic smoking article designs, if a smoker or consumer inadvertently blocks one or both of the air vent holes (or cartomizer holes) partially or completely, this can result in an increase in the RTD of the article 100. Accordingly, it would be desirable to provide an electronic smoking article 100, wherein the hole(s) or passage(s), which control the resistance-to-draw (RTD), are inside the electronic smoking article 100 as disclosed herein. In addition, it would be desirable to have an electronic smoking article 100 that is configured such that if the smoker and/or consumers blocks or obstructs one or more of the air vent holes with his or her fingers, the blockage or obstruction of the one or more air vent holes will not significantly influence the resistance-to-draw (RTD).

In accordance with exemplary embodiments, as shown in FIGS. 1-9, the resistance-to-draw (RTD) can be located inside the electronic smoking article in such a way that the airflow is not impacted by the usage behavior of the consumer, for example, how the smoker and/or consumer holds the electronic smoking article. In accordance with an exemplary embodiment, an electronic smoking article is disclosed having a gasket with a central, longitudinal air passage having a fixed diameter (or hole size), which can be configured to control a desired resistance-to-draw (RTD) of the electronic smoking article. In addition, by controlling the desired resistance-to-draw from within the electronic smoking article, the size of the one or more inlets or vent holes in the outer housing become less critical, such that the resistance-to-draw of the electronic smoking article 100 is not impacted by the usage behavior of the consumer, for example, how he or she handles the electronic smoking article.

Figure 1:
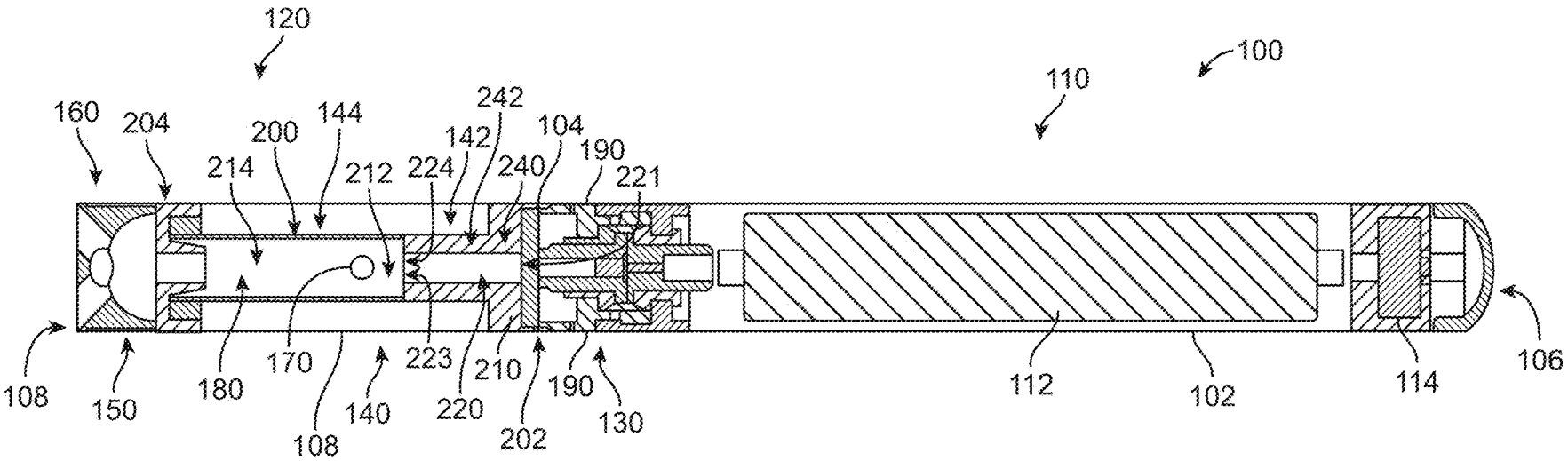
FIG. 1 is a cross-section view of an electronic smoking article in accordance with an exemplary embodiment.

FIG. 1 is a cross-sectional view of a schematic diagram of an electronic smoking article 100, such as an electronic cigarette according to an exemplary embodiment. As shown in FIG. 1, the electronic smoking article 100 comprises a reusable fixture (or first section) 110, and a replaceable cartomizer section (or second section) 120, which are coupled together at a threaded joint (not shown) or by other convenience such as a snug-fit, snap-fit, detent, clamp and/or clasp.

In accordance with an exemplary embodiment, the first section 110 can house a power supply 112 and control circuitry 114. In accordance with an exemplary embodiment, the replaceable cartomizer section 120 includes a connector portion 130, a cartomizer 140, a condensation chamber 150, and a mouth-end insert 160.

The reusable fixture 110 and the cartomizer section 120 have a generally cylindrical outer housing 102 extending in a longitudinal direction along the length of the electronic smoking article 100. In accordance with an exemplary embodiment, the electronic smoking article 100 is formed so that the diameter of the electronic cigarette is substantially uniform along the length thereof. In accordance with an exemplary embodiment, the outer cylindrical housing 102 is substantially continuous along the length thereof and can be rigid.

In accordance with an exemplary embodiment, a pressure activated switch (not shown) can be positioned on an outer surface of the outer cylindrical housing 102, which acts to activate a heater. By applying manual pressure to the pressure switch, the power supply is activated and an electric current heats a liquid or liquid material 144 in the cartomizer 140 via electrical contacts so as to volatilize the liquid material 144. For example, a depression (not shown) can be formed in the outer cylindrical housing 102 to indicate where the smoker or consumer should apply pressure. The depression can extend fully or partially about the circumference of the outer cylindrical housing 102.

In accordance with an exemplary embodiment, the power supply 112 is activated upon application of manual pressure to the pressure switch and the cartomizer 140 is heated to form a heated section wherein the liquid material 144 within a fluid reservoir (or liquid supply region) 142 is volatilized. Upon discharge from a central air flow channel 180, the volatilized material expands, mixes with air and forms an aerosol.

In accordance with an exemplary embodiment, the cartomizer section 120 includes the reservoir 142 including a liquid material 144 and a heater and wick arrangement 170 in fluid communication with the reservoir 142, such that the wick arrangement 170 draws or wicks the liquid material 144 from the reservoir 142 and heats the liquid material 144 to form an aerosol in a central air channel 180. The cartomizer section 120 includes an outer tube (or housing) 104 extending in a longitudinal direction and an inner tube (or chimney) 200 coaxially positioned within the outer tube 104.

In an exemplary embodiment, the power supply 112 is operable to apply voltage across a heater and wick arrangement 170 associated with the cartomizer 140 and volatilizes the liquid material 144 contained therein according to a power cycle of either a predetermined time period, such as a 5 second period, or for so long as the pressure activated switch is pressed. The heater and wick arrangement 170 can include a heater 172 and a filamentary wick 174.

In use, for example, liquid material 144 is transferred from the reservoir 142 in proximity of the heater and wick arrangement 170 by capillary action of the filamentary wick 174. In an embodiment, the filamentary wick 174 has a first end portion and a second end portion, wherein the first end and the second end extend into opposite sides of the reservoir for contact with liquid material contained therein. Also preferably, the heater 172 at least partially surrounds a central portion of the filamentary wick 174 such that when the heater 172 is activated, the liquid in the central portion of the filamentary wick 174 is vaporized by the heater 172 to form an aerosol.

The filamentary wick 174 preferably comprises filaments having a capacity to draw a liquid, more preferably a bundle of glass (or ceramic) filaments and most preferably a bundle comprising a group of windings of glass filaments, preferably three of such windings, all which arrangements are capable of drawing liquid via capillary action via interstitial spacings between the filaments. Alternatively, in place of the filamentary wick 174, a heated capillary or capillary tube (not shown) can be used, which volatilizes a liquid such as by way of the teachings set forth in U.S. Pat. No. 5,743,251, which is incorporated herein in its entirety by reference thereto.

In accordance with an exemplary embodiment, the inner tube 200 has an upstream end portion 202 and a downstream end portion 204. An upstream gasket (or seal) 210 is fitted into the upstream end portion 202 of the inner tube 200, while at the same time, an outer perimeter 222 of the gasket 210 provides a liquid-tight seal with an interior surface 108 of the outer housing 104. In accordance with an exemplary embodiment, the gasket 210 preferably includes a central, longitudinal air passage (or channel) 220, which opens into an interior 212 of the inner tube 200 that defines a central channel 180.

Figure 10:
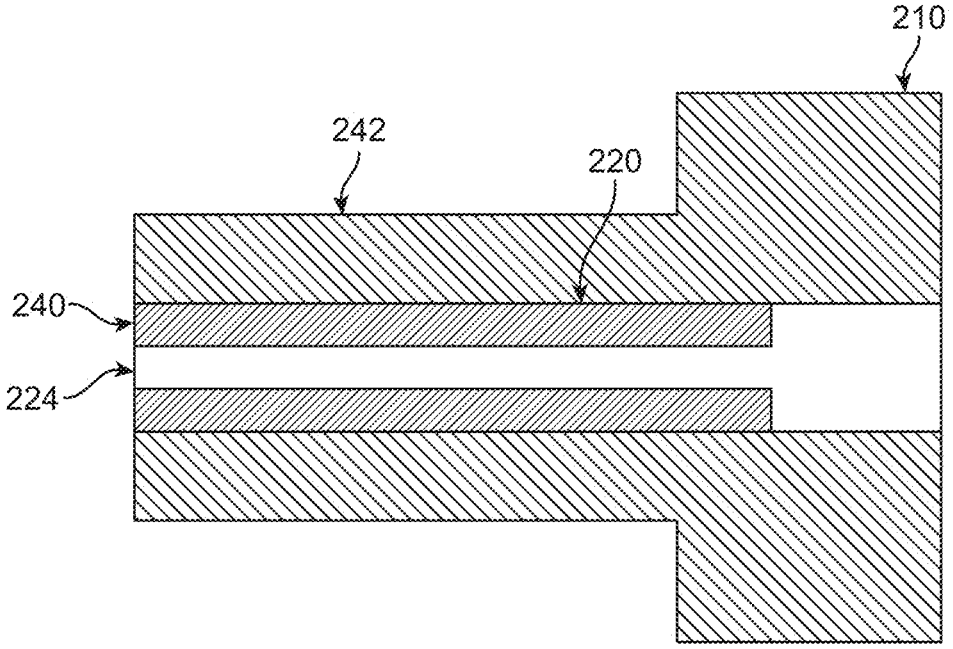
FIG. 10 is a cross-sectional side view of the gasket of the electronic smoking article of FIG. 2.

Referring to FIG. 10, in accordance with an exemplary embodiment, the gasket 210 can include a rigid tubular gasket insert 240, which can be inserted into a central passage 220 of the gasket 210 and extends at least partially through the central passage 220 of the gasket 210. In accordance with an exemplary embodiment, the gasket insert 240 can be a metal tubular insert, which is configured to provide a precisely defined orifice or outlet 224 so to consistently provide a desired resistance-to-draw from one electronic smoking article 100 to the next. In this embodiment, the gasket 210 may be constructed of a resilient material so that its capacity to seal remains intact. The rigid insert 240 not only provides a way to exactly control RTD, but also facilitates effecting a change in the desired RTD, which would require only a change in the inner diameter of the insert 240.

The central, longitudinal passage 220 has an upstream end 221 and a downstream end 223. In accordance with an exemplary embodiment, air enters the electronic smoking article 100 through one or more inlets 190 in the outer housing 104. The upstream end 221 of the longitudinal air passage 220 is in fluid communication with the one or more inlets 190. In accordance with an exemplary embodiment, the downstream end 223 of the longitudinal passage 220 has a gasket outlet 224. Once the air enters the cartomizer section 120, the air passes through the gasket outlet 224 before reaching the heater and wick arrangement 170. In accordance with an exemplary embodiment, the gasket outlet 224 can have a fixed cross-sectional shape, for example, round or oval, which helps control the overall resistance-to-draw (RTD) of the electronic smoking article 100 as opposed to external cartomizer holes or vents within the outer housing 104.

The power source 112 can be a Lithium-ion battery or one of its variants, for example a Lithium-ion polymer battery. The power source 112 may be a Nickel-metal hydride battery, a Nickel cadmium battery, a Lithium-manganese battery, a Lithium-cobalt battery or a fuel cell. In that case, preferably, the electronic smoking article 100 is usable by a smoker until the energy in the power supply is depleted. The power source 112 may be rechargeable and include circuitry allowing the battery to be chargeable by an external charging article. In that case, the circuitry, when charged, provides power for a pre-determined number of puffs, after which the circuitry may be re-connected to an external charging article.

The electronic smoking article 100 also includes control circuitry 114, which can be on a printed circuit board (not shown). Once the pressure switch is pressed, the power supply is activated and supplies power to the heater 172. The control circuitry 114 can also include a heater activation light (not shown) operable to glow when the heater 172 is activated. Preferably, the heater activation light comprises an LED and is at an upstream end 106 of the electronic smoking article 100 so that the heater activation light makes end 106 glow with the appearance of a burning coal during a puff.

The control circuitry 114 is electrically connected to the pressure switch (not shown) and supplies power to a heater 172 of a heater and wick arrangement 170, which is responsive to pressing the pressure switch, preferably with a maximum, time-period limiter (e.g. a timing circuit). The control circuitry 114 can also include a timer operable to limit the time for which power is supplied to the heater 172. The time-period of the electric current supply to the heater 172 may be pre-set depending on the amount of liquid desired to be vaporized. The control circuitry 114 can be programmable for this purpose. The control circuitry can be an application specific integrated circuit (ASIC).

In accordance with an exemplary embodiment, the cartomizer section 120 includes a reservoir 142 including a liquid material 144 and a heater and wick arrangement 170 that draws or wicks liquid material 144 from the reservoir 142 and heats the liquid to form an aerosol in a central air channel 214. Upon completing the threaded connection, the power source 112 is electrically connected with the heater and wick arrangement 170. The liquid material 144 can include a tobacco-containing material including volatile tobacco flavor compounds, which are released from the liquid material 144 upon heating. The liquid material 144 may also be a tobacco flavor containing material and/or a nicotine-containing material. Alternatively, or in addition, the liquid material 144 may include a non-tobacco material and/or may be nicotine-free. For example, the liquid material 144 may include water, solvents, ethanol, plant extracts and natural or artificial flavors. Preferably, the liquid material 144 further includes an aerosol former. Examples of suitable aerosol formers are glycerine and propylene glycol.

The electronic smoking article 100 further includes a mouth-end insert 160, which is in fluid communication with the condensation chamber 150 and includes at least two diverging outlets (not shown), for example 3, 4, 5, or preferably 6 to 10 outlets or more. Preferably, four outlets of the mouth-end insert 160 are located at ends of off-axis passages and are angled outwardly in relation to the longitudinal direction of the electronic smoking article 100 (i.e., divergently). As used herein, the term "off-axis" denotes at an angle to the longitudinal direction of the electronic cigarette. Also preferably, the mouth-end insert 160 includes outlets uniformly distributed around the mouth-end insert 160 so as to substantially uniformly distribute aerosol in a smoker's mouth during use. Thus, as the aerosol passes into a smoker's mouth, the aerosol enters the mouth and moves in different directions so as to provide a full mouth feel as compared to electronic cigarettes having an on-axis single orifice, which directs the aerosol to a single location in a smoker's mouth.

In an embodiment, the electronic smoking article 100 is about the same size as a conventional cigarette. In some embodiments, the electronic cigarette 60 can be about 80 mm to about 110 mm long, preferably about 80 mm to about 100 mm long and about 7 mm to about 8 mm in diameter. For example, in an embodiment, the electronic cigarette is about 84 mm long and has a diameter of about 7.8 mm.

The outer cylindrical housing 102 of the electronic smoking article 100 may be formed of any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK), ceramic, low density polyethylene (LDPE) and high density polyethylene (HDPE). Preferably, the material is light and non-brittle. Thus, the outer cylindrical housing 102 can be formed of a variety of materials including plastics, rubber and combinations thereof. In a preferred embodiment, the outer cylindrical housing 102 is formed of silicone. The outer cylindrical housing 102 can be any suitable color and/or can include graphics or other indicia printed thereon.

The heater and wick arrangement 170 can include an electrical heating element. The heater portion 172 of the heater and wick arrangement 170 preferably includes an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may include doped or undoped ceramics.

In an exemplary embodiment, the volatilized liquid material 144 formed as described herein can at least partially condense to form an aerosol including particles. Preferably, the particles contained in the vapor and/or aerosol range in size from about 0.5 micron to about 4 microns, preferably about 1 micron to about 4 microns. Also preferably, the particles are substantially uniform throughout the vapor and/or aerosol.

Figure 2:
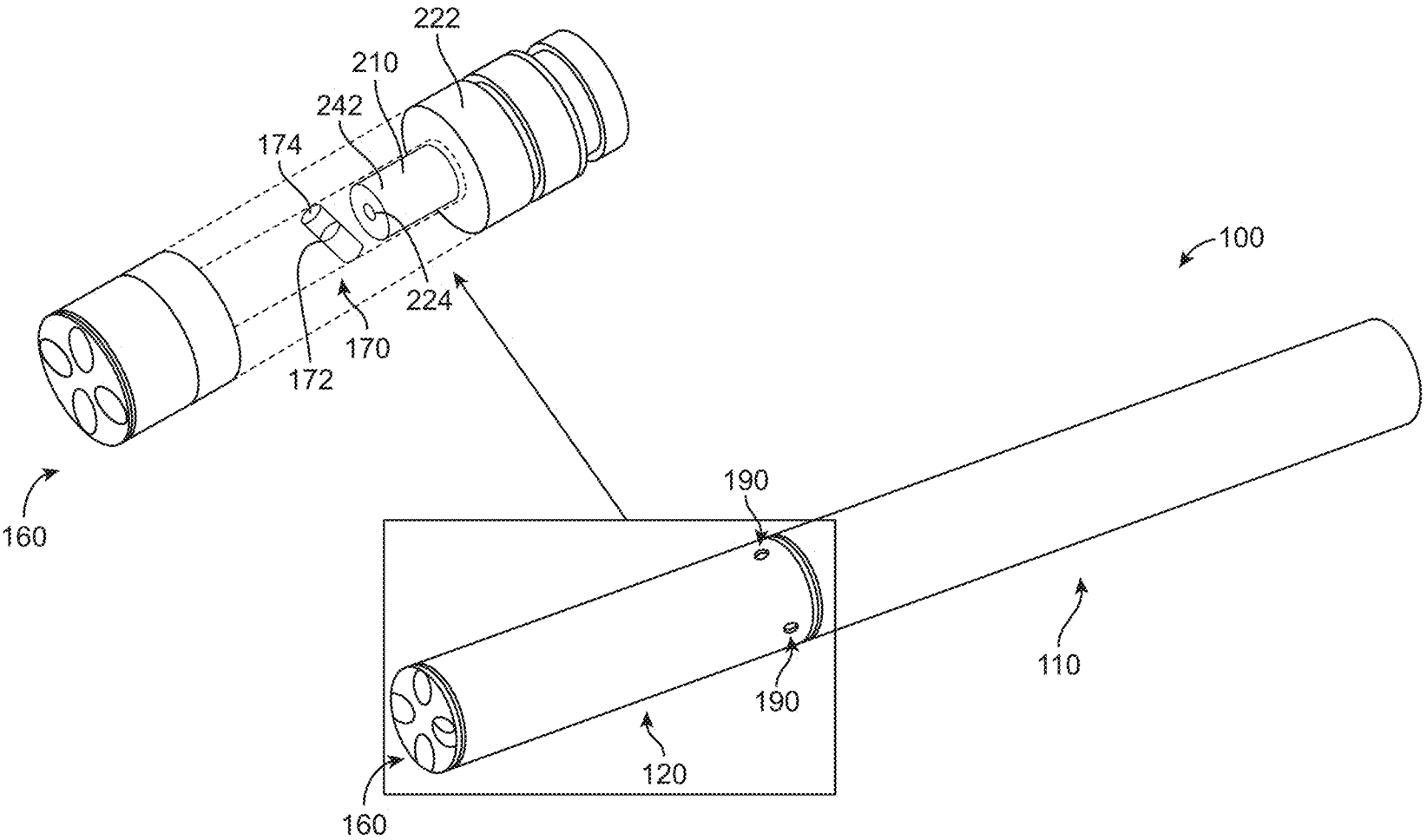
FIG. 2 is a perspective view of the cartomizer section of an electronic smoking article with and without the outer housing according to an exemplary embodiment.

FIG. 2 is a perspective view of the gasket 210 of the cartomizer section 140 of an electronic smoking article 100 with and without the outer housing 104 according to an exemplary embodiment. As shown in FIG. 2, the gasket 210 can include an annular portion 242 having a central, longitudinal air passage 220 having a fixed inner diameter. In accordance with an exemplary embodiment, the longitudinal air passage 220 can be configured to provide a desired resistance-to-draw (RTD) to the smoking article 100, when a total air flow area of the one or more inlets 190 of the outer cylindrical housing 102 is greater than a cross-sectional area of the longitudinal air passage 220 of the gasket 210. In accordance with an exemplary embodiment, by modifying or changing the size or diameter of the longitudinal air passage 220 of the gasket 210 and corresponding cross-sectional area (or diameter) of the gasket outlet 224, the RTD of the electronic smoking article can be controlled from inside the electronic smoking article 100 rather than based on the inlets 190 on the outer housing 102.

In accordance with another exemplary embodiment, the gasket 210 can be made out of any hard material that is easily machineable, for example, plastic (PET, PEEK), stainless steel or metal to maintain a desired diameter of the longitudinal air passage 220 of the gasket 210, which can be used to define the RTD of the electronic smoking article. In accordance with an exemplary embodiment, for example, if the gasket 210 is manufactured from a relatively hard material, an annular seal or O-ring (not shown) can be positioned around the outer perimeter 222 of the gasket 210 to form a seal between the outer perimeter 222 of the gasket 210 and inner portion of the outer housing 104.

Figure 3:
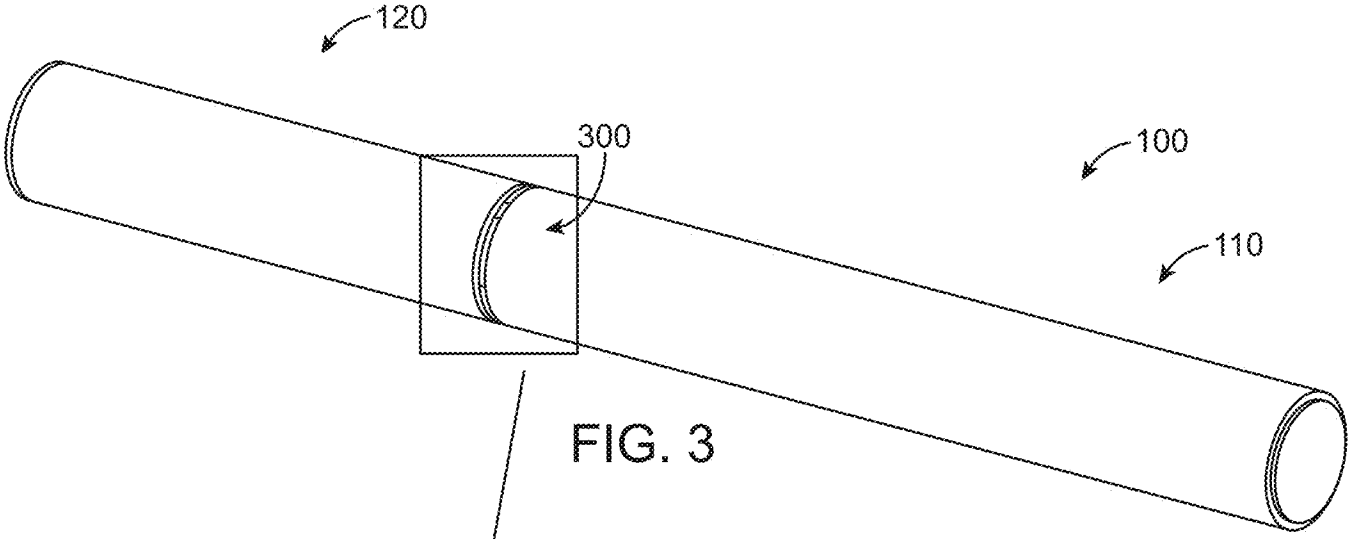
FIG. 3 is a perspective view of an electronic smoking article in accordance with an exemplary embodiment.

FIG. 3 is a perspective view of an electronic smoking article 100 having a connector 300 for connecting the reusable fixture 110 to the cartomizer section 120. In accordance with an exemplary embodiment, air flow enters the electronic smoking article 100 through a plurality of circumferentially spaced apart slots 302 generated by "castling" within the connector 300. The plurality of slots 302 in combination with an outer surface of the cartomizer section 120 forms a continuous annular channel 350 between an inner surface of the plurality of flanges 320 and the outer surface of the cartomizer section 120. The continuous annular channel 350 is configured to be in fluid communication with the one or more cartomizer vent holes 340. After entering through the plurality of slots 302 into the annular channel 350, the air enters the cartomizer 140 through one or more cartomizer vent holes 340, which are in fluid communication with the annular channel 350.

In accordance with an exemplary embodiment, the one or more cartomizer vent holes 340 are circumferentially spaced around the cartomizer section 120 and provide a controlling parameter for the resistance-to-draw (RTD) of the electronic smoking article 100. In accordance with an exemplary embodiment, for example, the electronic smoking article 100 can be configured with two cartomizer vent holes 340, which are circumferentially spaced apart approximately 180 degrees from one another on an outer portion of the cartomizer 140. The two or more cartomizer vent holes 340 are configured to be in fluid communication with the longitudinal air passage 220 of the cartomizer 140.

In accordance with an exemplary embodiment, depending upon the RTD desired, the one or more cartomizer vent holes 340 and the slots 302 within the connector 300 are configured in such a way that blocking the cartomizer vent holes 340 does not affect the RTD of the electronic smoking article 100. For example, the number and size of slots 302 can be designed in such a way that blocking any of the slots 302 would not change the RTD, which allows consumers to hold and use the article 100 as per their convenience. In accordance with an exemplary embodiment, a combined air flow area of the plurality of circumferentially spaced apart slots 302 is preferably greater than a combined cross-sectional area of the one or more cartomizer holes 340, which allows the one or more cartomizer holes 340 to control the resistance-to-draw of the electronic smoking article.

Figure 4:
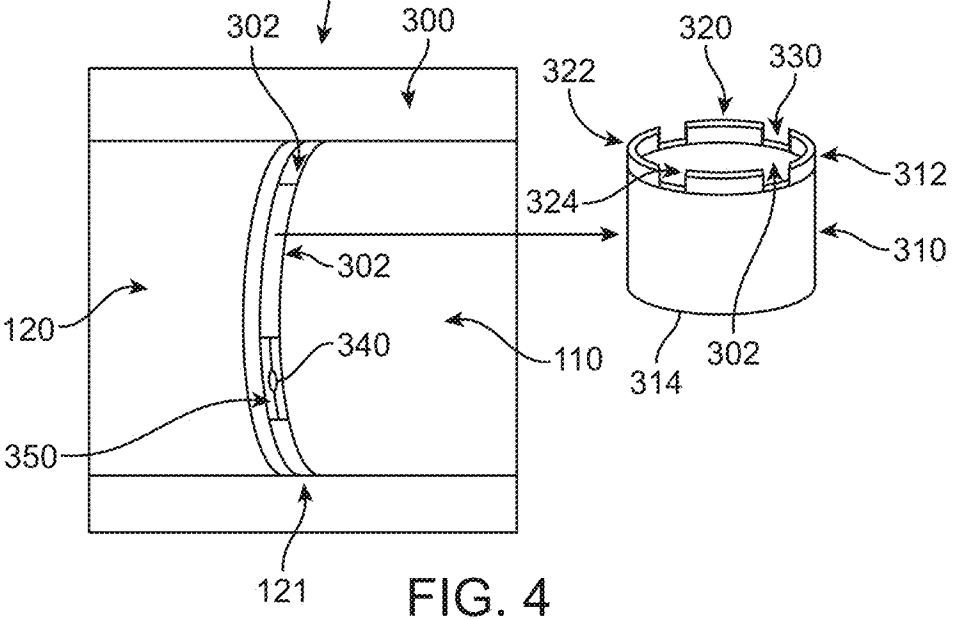
FIG. 4 is a perspective view of the connector as shown in FIG. 3.

As shown in FIG. 4, the connector 300 has a cylindrical housing 310 with a first end 312 and a second end 314. The first end 312 has a plurality of flanges 320 (or "castles"), which are concentric to the first end 312 of the connector 300, and one or more openings 330 formed between the plurality of flanges 320. The plurality of flanges 320 and the one or more openings 330 form the plurality of slots 302 when the reusable fixture (or first section) 110 and the replaceable cartomizer section (or second section) 120 are coupled together. The one or more openings 330 are configured to allow air to enter into a continuous annular channel 350 on an upstream end 121 of the cartomizer section 120. Each of the plurality of flanges 320 preferably has a relatively round portion 322 and an angled portion 324.

Figure 5:
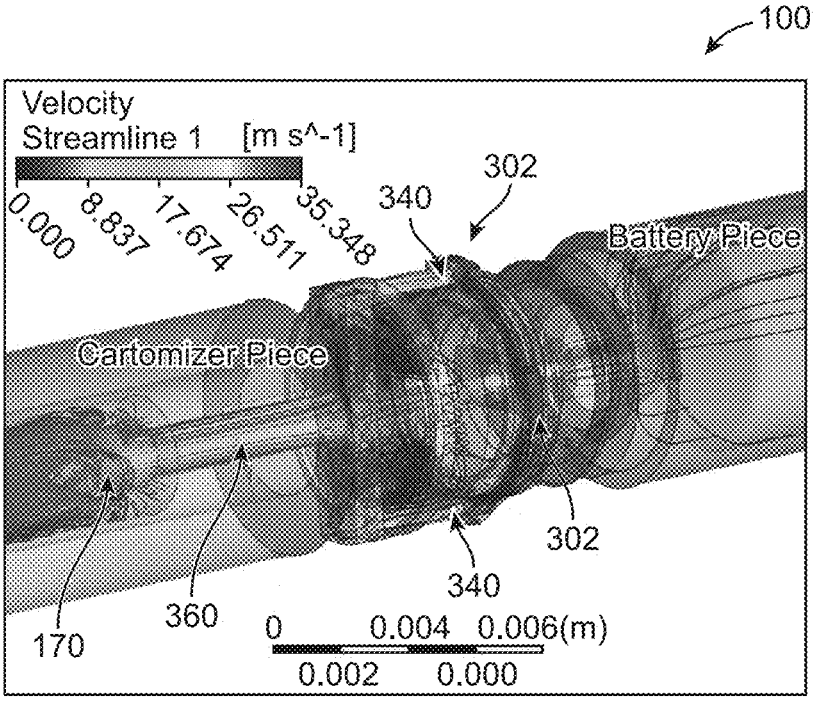
FIG. 5 is a perspective view of an electronic smoking article having a connector as shown in FIG. 3 in accordance with an exemplary embodiment.
Figure 6:
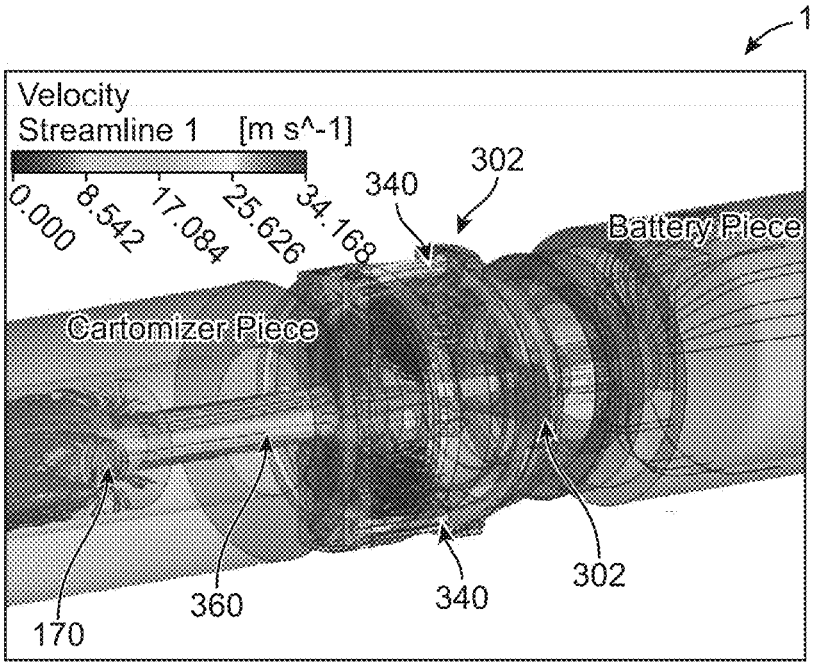
FIG. 6 is another perspective view of an electronic smoking article having a connector as shown in FIG. 3 in accordance with an exemplary embodiment.

In accordance with an exemplary embodiment as shown in FIGS. 4-6, the connector 300 can include four slots 302, which includes two diametrically opposite slots 302, which are aligned with two or more cartomizer vent holes 340 with the other two slots 302 not in alignment with the two or more cartomizer vent holes 340. As shown in FIG. 5, the two or more cartomizer vent holes 340 are located within the continuous annular channel 350. In accordance with an exemplary embodiment, openings for each of the two or more cartomizer vent holes 340 are configured to face the upstream end 106 of the article 100, such that the axes for each of the two or more cartomizer vent holes 340 are preferably perpendicular to the outer housing 102 of the electronic smoking article 100.

In accordance with an exemplary embodiment, for example, to achieve a target RTD of about 100 to 130 mm of water, the cartomizer vent holes 340 can have a diameter of about 0.50 to about 1.0 mm, and more preferably a diameter of about 0.63 mm and the width of the one or more slots can be about 1.0 mm to 3.0 mm, for example, 1.25 mm to 2.75 mm. However, the diameter of the of the cartomizer holes 340 can vary from about 0.50 mm to about 1.50 mm depending on the desired resistance-to-draw of the electronic smoking article in combination with one or more design features of the cartomizer 140 and the amount of air flow which is desired in the interior 212 of the inner tube 200 of the cartomizer 140.

FIG. 5 is a perspective view of an electronic smoking article having a connector as shown in FIG. 3 in accordance with an exemplary embodiment. For example, in accordance with an exemplary embodiment, in order to achieve a target resistance-to-draw (RTD) in a range of about 100 mm to about 130 mm of water, the cartomizer hole 340 size can be approximately 0.63 mm, which can produce a resistance-to-draw of about 119 mm of water when each of the four slots 302 are open and/or unobstructed.

As shown in FIG. 5, the airflow 360 enters the electronic smoking article 100 through the one or more slots 302 and into the cartomizer 140 through two or more cartomizer vent holes 340, which are in fluid communication with the heater and wick arrangement 170. In accordance with an exemplary embodiment, the two or more cartomizer vent holes 340 are positioned within the outer cylindrical housing 102 such that if one or more of the slots 302 is blocked or obstructed, the flow of air 360 is allowed to enter the cartomizer vent holes 340 via the annular channel 350.

FIG. 6 is another perspective view of an electronic smoking article having a connector as shown in FIG. 3 in accordance with an exemplary embodiment. For example, as shown in FIG. 6, in accordance with an exemplary embodiment, the electronic smoking article 100 can include two cartomizer vent holes 340 having a diameter of approximately 0.63 mm and four slots 302. In accordance with an exemplary embodiment, in which both the slots 302 aligned with the cartomizer holes 340 can produce a resistance-to-draw (RTD) of about 135 mm of water. In an exemplary embodiment, in which one slot 302 aligned with one of the two cartomizer holes 340 is blocked and/or obstructed, and a second slot 302 at about 90 degrees to the first slot 302 is also blocked and which is not aligned with the second of the two cartomizer holes 340, the electronic smoking article 100 can produce a resistance-to-draw of about 137 mm of water.

Figure 7:
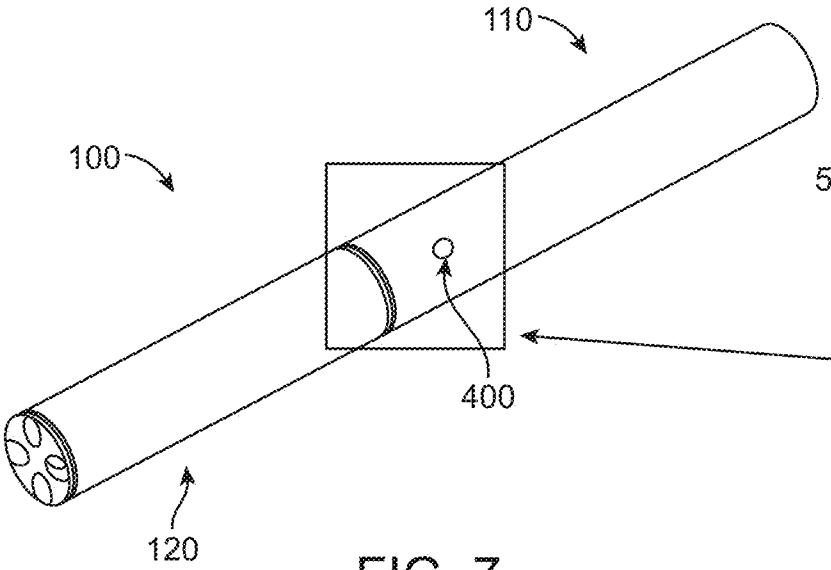
FIG. 7 is a perspective view of an electrical smoking article in accordance with an exemplary embodiment.
Figure 9:
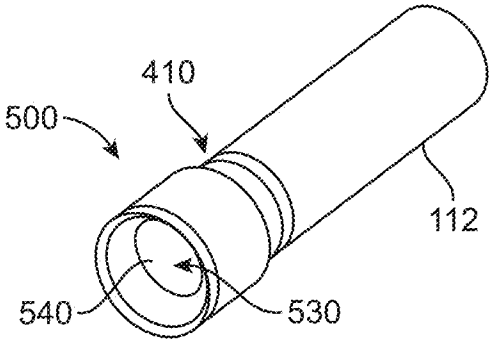
FIG. 9 is a perspective view of the flow control insert as shown in FIG. 7 in accordance with an exemplary embodiment.

FIG. 7 is a perspective view of an electronic smoking article 100 having one or more vent holes 400 within the reusable fixture 110 of the electronic smoking article 100 and a flow control insert 500. In accordance with an exemplary embodiment, the air vent holes 400 can be placed in the reusable fixture (or battery end) 110 of the electronic smoking article 100. As shown in FIG. 7, the air enters the electronic smoking article 100 through the plurality of vent holes 400, which are in fluid communication with the opening (not shown) on the upstream end of the cartomizer 140 in the cartomizer section 120 to the electronic smoking article 100. For example, the plurality of vent holes 400 can be in fluid communication with the gasket 210. The air will enter the cartomizer 140 through the gasket outlet 224.

Figure 8:
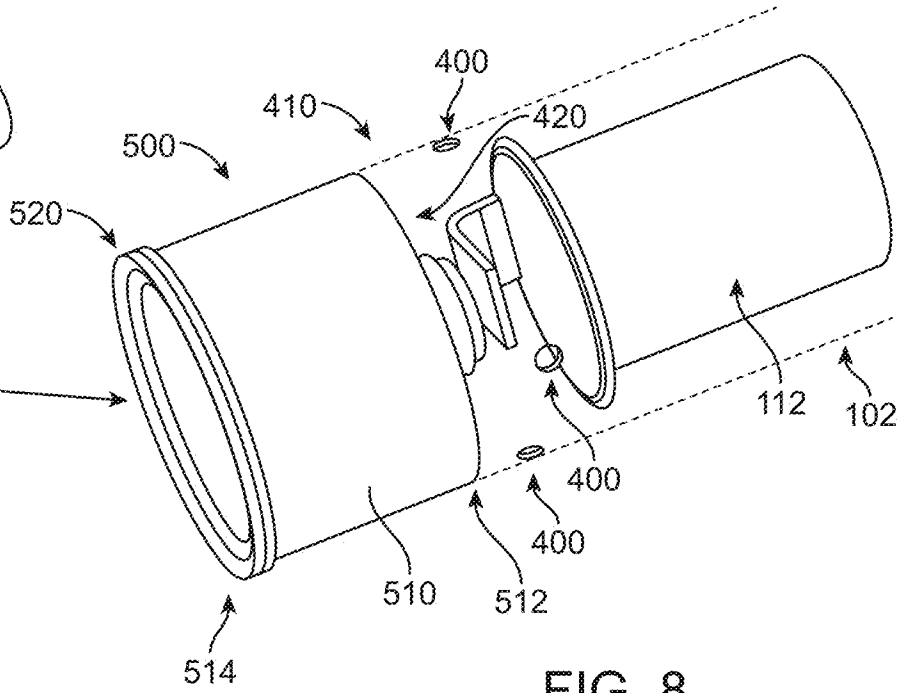
FIG. 8 is a perspective view of a flow control insert of the smoking article as shown in FIG. 7 in accordance with an exemplary embodiment.

FIG. 8 is a perspective view of a flow control insert 500 of the electronic smoking article 100 as shown in FIG. 7. As shown in FIG. 8, the one or more vent holes 400 can be positioned on a downstream portion of the reusable fixture 110, for example, at a downstream end of the power source (or battery) 112. The one or more vent holes 400 are preferably located around an outer circumference of the outer housing 102 in such a way that if one or more of the vent holes 400 are blocked during use, the blocking of the one or more holes 400 does not change the RTD of the electronic smoking article 100. In accordance with an exemplary embodiment, the one or more vent holes 400 are in fluid communication with an inner cavity 410 located between a downstream end of the power source 112 and an upstream end 420 of a flow control insert 500, which connects the reusable fixture 110 to the cartomizer section 140. The insert 500 can include a cylindrical housing 510 having an upstream end 512 and a downstream end 514. In accordance with exemplary embodiment, the cylindrical housing 510 has a flange 520 on the downstream end 514. Upon assembly of the electronic smoking article 100, the flange 520 is visible between the reusable fixture 110 and the cartomizer section 140. In accordance with an exemplary embodiment, for example, an air flow area of the one or more vent holes 400 is greater than an air flow area (or cross-sectional area) of one or more cartomizer inlets 530.

In accordance with an exemplary embodiment as shown in FIG. 7, the insert 500 can have one or more cartomizer inlets 530 on an upstream plate 540, which controls the amount of air, which is delivered the cartomizer section 140. The one or more cartomizer inlets 530 are in fluid communication with the one or more vent holes 400 in the outer housing 102 and the inner cavity 410 and provide a means for controlling the amount of air flow to the cartomizer section 140 and the corresponding RTD of the electronic smoking article 100. In accordance with an exemplary embodiment, the one or more cartomizer inlets 530 is a single or one round opening positioned within a center portion of the upstream plate 540. For example, the one or more cartomizer inlets 530 can have a diameter of about 0.8 to 1.0 mm.

The teachings herein are applicable to electronic cigars, and references to "electronic smoking article(s)" is intended to be inclusive of electronic cigars, electronic cigarettes and the like.

When the word "about" is used in this specification in connection with a numerical value, it is intended that the associated numerical value include a tolerance of ±10% around the stated numerical value. Moreover, when reference is made to percentages in this specification, it is intended that those percentages are based on weight, for example, weight percentages.

Moreover, when the words "generally" and "substantially" are used in connection with geometric shapes, it is intended that precision of the geometric shape is not required but that latitude for the shape is within the scope of the disclosure. When used with geometric terms, the words "generally" and "substantially" are intended to encompass not only features, which meet the strict definitions, but also features, which fairly approximate the strict definitions.

It will now be apparent that a new, improved, and non-obvious electronic cigarette has been described in this specification with sufficient particularity as to be understood by one of ordinary skill in the art. Moreover, it will be apparent to those skilled in the art that numerous modifications, variations, substitutions, and equivalents exist for features of the electronic cigarette, which do not materially depart from the spirit, and scope of the invention. Accordingly, it is expressly intended that all such modifications, variations, substitutions, and equivalents, which fall within the spirit and scope of the invention as defined by the appended claims, shall be embraced by the appended claims.

What is claimed is:

1. A first e-vaping section, comprising:

a first housing, the first housing at least partially defining at least one inlet configured to allow air to be drawn into and through an airflow path defined within the first e-vaping section;

a reservoir in the first housing, the reservoir being configured to contain a pre-vapor formulation;

a heater and wick arrangement in fluid communication with the reservoir and the airflow path, the heater and wick arrangement being configured to volatilize the pre-vapor formulation to produce a vapor;

a connector on a first end of the first e-vaping section;

an electrical terminal held within connector;

an annular seal in fluid communication with the at least one inlet, the annular seal defining a first air passage of the airflow path; and a flow restrictor being held by the annular seal, the flow restrictor defining a second air passage of the airflow path, the flow restrictor being configured to provide a desired resistance-to-draw (RTD) for the first e-vaping section, the annular seal encompassing the flow restrictor.

2. The first e-vaping section of claim 1, wherein a combined airflow cross-sectional area of the at least one inlet is greater than an airflow cross-sectional area of the second air passage.

3. The first e-vaping section of claim 1, wherein the first air passage is downstream of the connector and the electrical terminal relative to a direction of an airflow through the airflow path during a normal operational use of the first e-vaping section.

4. The first e-vaping section of claim 3, wherein the flow restrictor is upstream of the heater and wick arrangement relative to a direction of an airflow through the airflow path during a normal operational use of the first e-vaping section.

5. The first e-vaping section of claim 1, wherein the flow restrictor is upstream of the heater and wick arrangement relative to a direction of an airflow through the airflow path during a normal operational use of the first e-vaping section.

6. The first e-vaping section of claim 1, wherein the flow restrictor is made from a first material that is a different hardness relative to a second material for the annular seal.

7. The first e-vaping section of claim 6, wherein the first material is at least one of a plastic, a metal, or combinations thereof.

8. The first e-vaping section of claim 1, wherein the flow restrictor is made from a first material that is harder than a second material for the annular seal.

9. The first e-vaping section of claim 1, the annular seal has an outer surface configured to seal with an interior surface of the first housing.

10. The first e-vaping section of claim 1, further comprising:

a mouth-end insert on a second end of the first e-vaping section, wherein the flow restrictor is positioned near the first end of the first e-vaping section, the flow restrictor being configured to control an amount of airflow into and through the first e-vaping section.

11. The first e-vaping section of claim 1, wherein the flow restrictor is a rigid tubular insert and the annular seal is a gasket.

12. The first e-vaping section of claim 1, wherein the flow restrictor is a gasket.

13. The first e-vaping section of claim 1, further comprising:

an inner tube defining a third air passage of the airflow path, wherein the heater and wick arrangement traverses the third air passage.

14. The first e-vaping section of claim 13, wherein a third end of the annular seal abuts a fourth end of the inner tube.

15. The first e-vaping section of claim 1, wherein the connector is one of a threaded connector, a snug-fit connector, a snap-fit connector, a detent, a clamp, a clasp, or combinations thereof.

16. The first e-vaping section of claim 15, wherein the first air passage is downstream of the connector and the electrical terminal relative to a direction of an airflow through the airflow path during a normal operational use of the first e-vaping section.

17. The first e-vaping section of claim 2, wherein the desired RTD is about 100 mm to 130 mm of water, the at least one inlet includes two inlets that each have a first internal diameter of about 0.5 to 1.0 mm, and the first air passage has an internal diameter of about 0.8 to 1.0 mm.

18. An e-vaping device, comprising:

the first e-vaping section of claim 1; and a second e-vaping section configured to connect to the first e-vaping section, the second e-vaping section including a power source.

19. The e-vaping device of claim 18, further comprising:

a second housing for the second e-vaping section, a first portion of the first housing and a second portion of the second housing collectively defining the at least one inlet.

20. The e-vaping device of claim 18, further comprising: control circuitry in the second e-vaping section, the control circuitry being configured to control a supply of power from the power source to the heater and wick arrangement.

* * * * *